US005541410A

United States Patent [19]

Dowben et al.

[11] Patent Number: 5,541,410

[45] Date of Patent: Jul. 30, 1996

[54] REDUCED DIAMETER RETRACTABLE CYLINDRICAL MIRROR ANALYZER

[75] Inventors: Peter A. Dowben, Crete; David N. McIlroy, Lincoln, Nebr.

[73] Assignee: Board of Regents, University of Nebraska-Lincoln, Lincoln, Nebr.

[21] Appl. No.: 500,726

[22] Filed: Jul. 11, 1995

[51] Int. Cl.[6] ..... H01J 49/48

[52] U.S. Cl. ..... 250/305

[58] Field of Search ..... 205/305

[56] References Cited

U.S. PATENT DOCUMENTS 4,048,498 9/1977 Gerlach et al. ..... 250/305

4,205,226 5/1980 Gerlach ..... 250/305

5,099,117 3/1992 Frohn et al. ..... 250/305

*Primary Examiner*—Jack I. Berman

*Attorney, Agent, or Firm*—Suiter & Associates PC

[57] ABSTRACT

A single pass cylindrical mirror analyzer for use in charged particle analysis has reduced size for mounting on a simple manipulator. The reduced size of the analyzer allows for placement of the analyzer on a linear motion feedtrough mounted on a conflat flange for insertion into and retraction from the analysis position. The reduced size of the cylindrical mirror analyzer in combination with good instrument resolution results in a versatile charged particle analyzer.

10 Claims, 3 Drawing Sheets

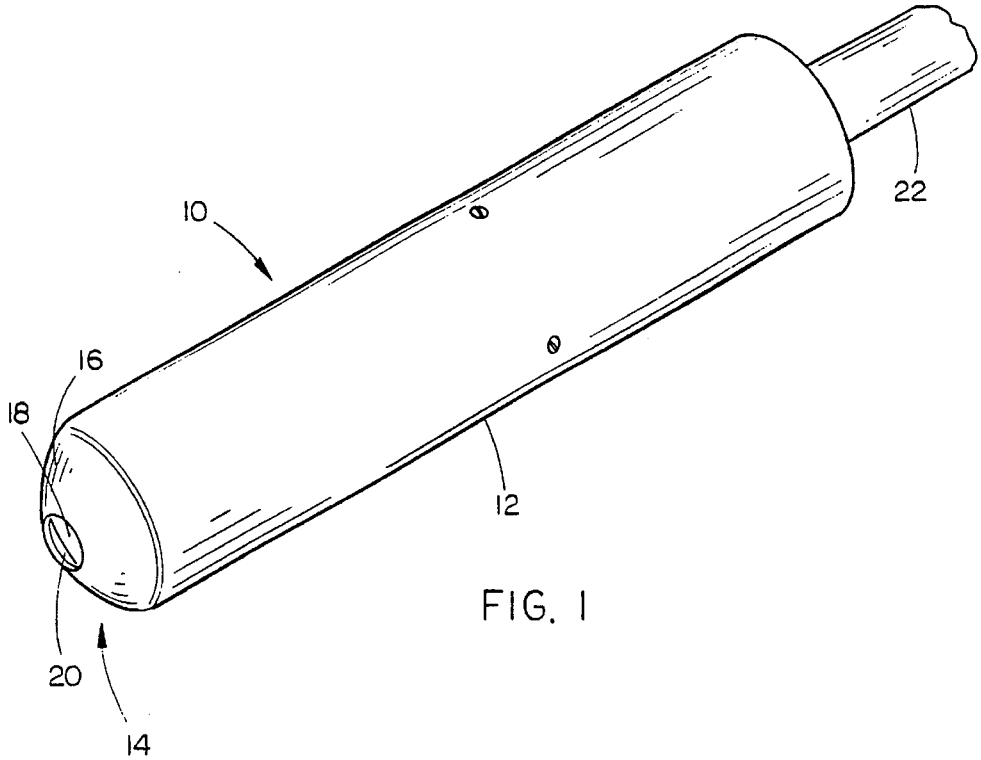
FIG. 1
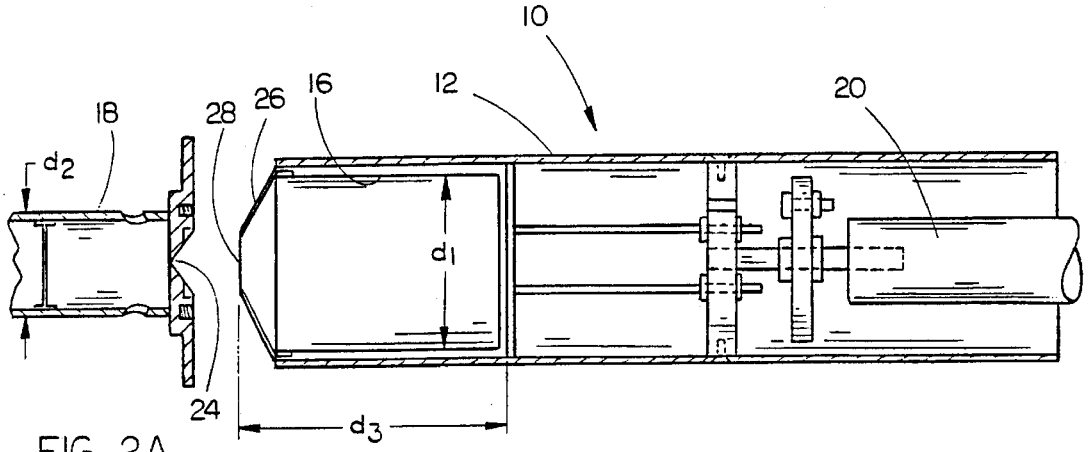
FIG. 2A
FIG. 2B

REDUCED DIAMETER RETRACTABLE CYLINDRICAL MIRROR ANALYZER

TECHNICAL FIELD

The present invention relates generally to cylindrical mirror analyzers and specifically to a retractable single pass cylindrical mirror analyzer having a reduced cylinder diameter.

BACKGROUND OF THE INVENTION

Cylindrical mirror analyzers are known in the art for use in scientific analysis of charged particles. Cylindrical mirror analyzers may be utilized to analyze the energy of charged particles such as electrons or ions in applications such as Auger electron spectroscopy, photoemission spectroscopy, low energy ion scattering and mass spectroscopy, for example. Typically, a charged particle source such as a crystal is bombarded with an excitation source which may be for example a beam of electrons, photons or x-rays. Upon bombardment of the source charged particles are emitted therefrom and received by the cylindrical mirror analyzer for detection and recording of the characteristic energy spectra exhibited by the charged particles. The amount of energy required to emit the charged particles from the source or various other atomic processes may be thereby experimentally determined, for example.

Previous cylindrical mirror analyzers have been large and bulky requiring fixed placement or placement on a complex manipulator to insert and manipulate the analyzer into an analysis position. The reason that prior cylindrical mirror analyzers have been large and bulky is that to attain high instrumental resolution larger diameter cylindrical mirror analyzers are generally required; thus the prior art teaches away from a reduced sized cylindrical mirror analyzer having high resolution. However, to date, no cylindrical mirror analyzer has been produced of a sufficiently reduced size and placed upon a simple linear motion feed-through drive. No cylindrical mirror analyzer has been constructed of a small enough size to be mounted on a simple linear motion manipulator while simultaneously having great enough resolution to perform meaningful charged particle analysis.

Thus, despite the efforts of those skilled in the art, there still exists a need for a versatile reduced sized cylindrical mirror analyzer which has a level of instrumental resolution suitable for charged particle spectroscopy and energy analysis.

SUMMARY OF THE INVENTION

The present invention provides a reduced sized retractable single pass cylindrical mirror analyzer mountable on a linear motion feedthrough. The analyzer may be utilized in a variety of charged particle analysis methods.

In a preferred embodiment the cylindrical mirror analyzer is constructed to fit on a linear motion feedthrough mounted on a 2.74" (70 mm) conflat flange for facilitated manipulation into the analysis position in a typical UHV (ultra high vacuum) chamber.

BRIEF DESCRIPTION OF THE DRAWINGS

The numerous objects and advantages of the present invention may be better understood by those skilled in the art by reference to the accompanying figures in which:

FIG. 1 is a general perspective view of the cylindrical mirror analyzer of the present invention.

FIGS. 2A and 2B are a detailed illustration of the inner parts of the cylindrical mirror analyzer of the present invention.

DETAILED DESCRIPTION

Figure 3:
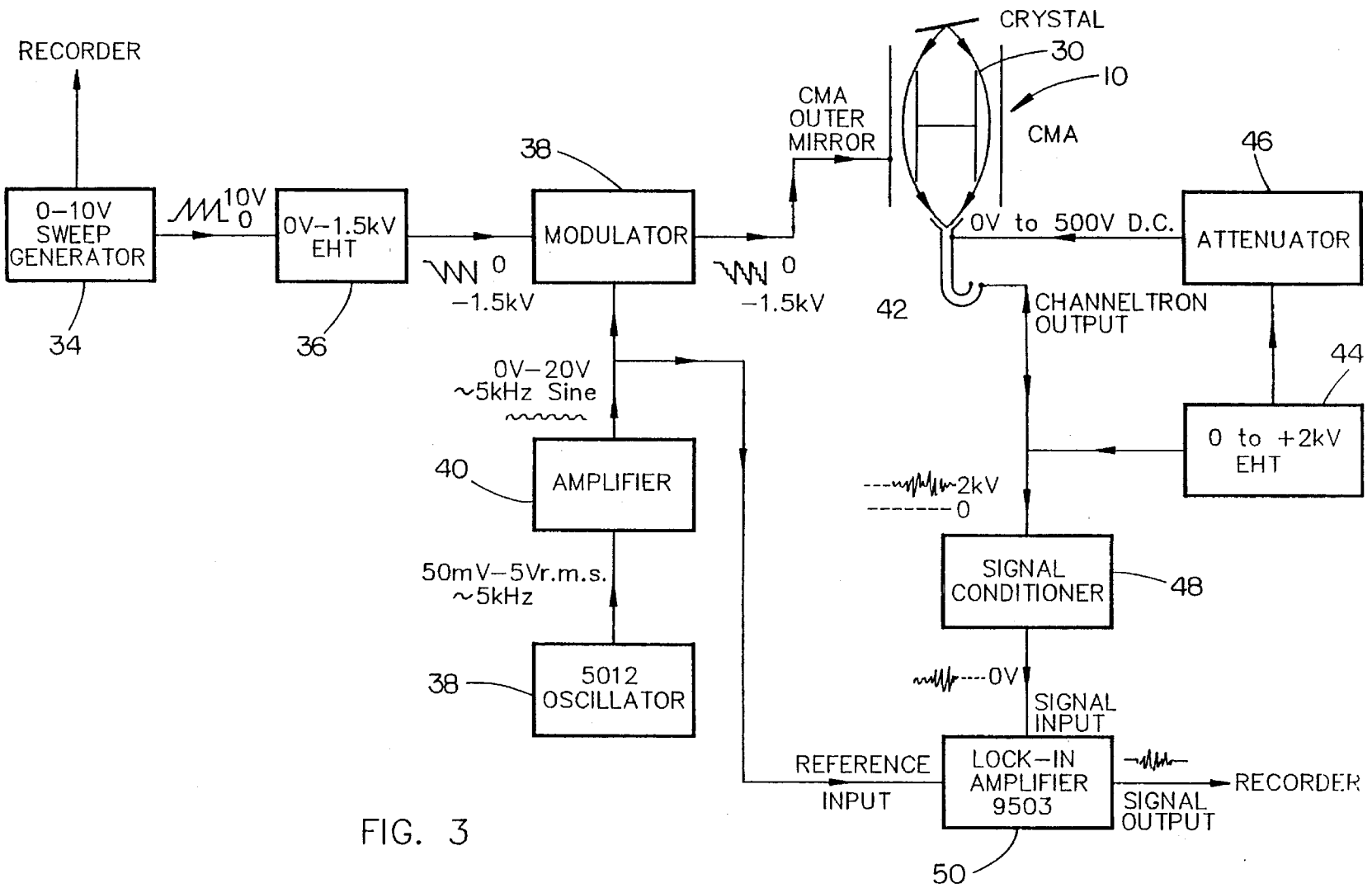
FIG. 3 is a diagrammatic schematic of a preferred embodiment of the cylindrical mirror analyzer illustrating the accompanying control system.

FIG. 1 shows a perspective view of the cylindrical mirror analyzer of the present invention. The analyzer 10 essentially comprises hollow outer cylindrical housing shell 12. At one end of the outer shell 12 is disposed the cylindrical mirror assembly 14 comprising an outer cylinder 16 and an inner cylinder 18 concentrically contained therein. A centrally located particle entry slit 20 of the inner cylinder 18 is exposed at the end of the analyzer 10 having the cylindrical mirror assembly 14 running generally along a diameter of the cylindrical outer shell 12. The outer cylindrical housing shell 12 is mounted at the opposite end on a linear motion feedthrough 22 for manipulation of the analyzer 10 into proper analysis positions.

FIG. 2 is a side elevation cutaway view of the cylindrical mirror analyzer 10 of FIG. 1. The outer cylindrical housing shell 12 of the cylindrical mirror analyzer 10 is composed of mu-metal to minimize resolution broadening effects which may be caused by stray magnetic fields. The inner diameter $d_1$ of the of the outer cylinder 16 is approximately 30 mm and may range up to 50 mm. The outer diameter $d_2$ of the inner cylinder 18 is approximately 15 mm and may range up to 40 mm. The overall length $d_3$ of the electro-optics is approximately 45 mm. The outer cylinder 16 further has a conical end cap 26 with an opening concentrically located thereon to expose the particle entry slit 20 of the inner cylinder 18 as shown in FIG. 1. Located at the rear of the inner cylinder 18 is a particle entry slit 24 for receiving particles entering the analyzer 10 through particle entry slit 20.

The inner cylinder 18 as shown by FIG. 2 (A) is mounted concentrically within the interior of the outer cylinder 16 shown in FIG. 2 (B) during normal operation of the cylindrical mirror analyzer 10. The cylindrical mirror analyzer 10 is mounted on a manipulator 20 which is preferably a simple linear motion feedthrough. The advantage of being able to mount the cylindrical mirror analyzer 10 on a simple linear motion feedthrough is the elimination of restraints on the chamber design in which the analyzer 10 is to be utilized that are otherwise imposed by the focusing requirements of conventional fixed or larger sized charged particle detectors.

The cylindrical mirror analyzer 10 of the present invention may be placed on a vacuum flange having a diameter less than 8 inches (203 mm), and is preferably mounted on a 2.75 inch (70 mm) diameter conflat flange. Overcrowding of the experimental area due to an overabundance of complex and bulky equipment required for manipulation of conventional analyzers is thereby reduced. The linear motion feedthrough 20 of the present invention may be utilized to position the cylinder at the optimum focal position by insertion or retraction thereof for receiving the charged particle stream which is approximately 6 mm from the particle entry slit 20, as shown in FIG. 1, in an exemplary embodiment. The cylindrical mirror analyzer 10 is preferably designed to have an optimal acceptance angle of the particle stream of 42° 18.5'.

FIG. 3 depicts the preferred control scheme of the cylindrical mirror analyzer of the present invention. The crystal mirror analyzer (CMA) 10 is positioned to receive a charged particle stream 30 which may be produced, for example, from a crystal 32 near the entry slit from which charged particles are emitted the crystal 32 is bombarded with x-rays. Other various methods of producing a stream of charged particles to be analyzed may also be implemented. The inner cylinder 18 of the analyzer 10 is held to ground potential while the outer cylinder 16 receives a modulated high voltage signal for control of the charged particle stream 30 such that desired spectra are received and detected.

A sweep generator 34 produces a sawtooth output voltage ramped from 0 V to 10 V and produces a reference output to a signal recorder (not shown). The sawtooth output voltage drives −1.5 kV EHT (extremely high tension) generator 36 which produces a sawtooth output ramped from 0 V to −1.5 kV, which is then fed into the input of a signal modulator 38. The modulator 38 modulates the output signal of EHT generator 38 with a 20 V sinewave signal of approximately 5 kHz in frequency. The sinewave is generated by oscillator 38 and amplified to 20 V by amplifier 40. The output of the modulator 38 is fixed to the outer cylinder 16 for controlling the potential thereof with respect to the inner cylinder 18 which thereby controls the charged particle stream 30.

A commercial channeltron 42 receives the charged particle stream 30 for charged particle detection. Channeltron 42 receives a 0 V to 500 V dc signal generated by 2 kV EHT generator 44 having an output signal attenuated by attenuator 46. EHT generator 44 also has an output connected to the output of the channeltron 42 which produces a varying output signal with a 2 kV dc signal superimposed thereon. The output signal of the channeltron 42 is passed through a signal conditioner 48 which removes the dc component therefrom. The output signal is received by a lock-in amplifier 50 which also receives a reference input signal from amplifier 40. The output signal of the lock-in amplifier 50 is sent to the recorder (not shown) for analysis of the experimental results.

Figure 4:
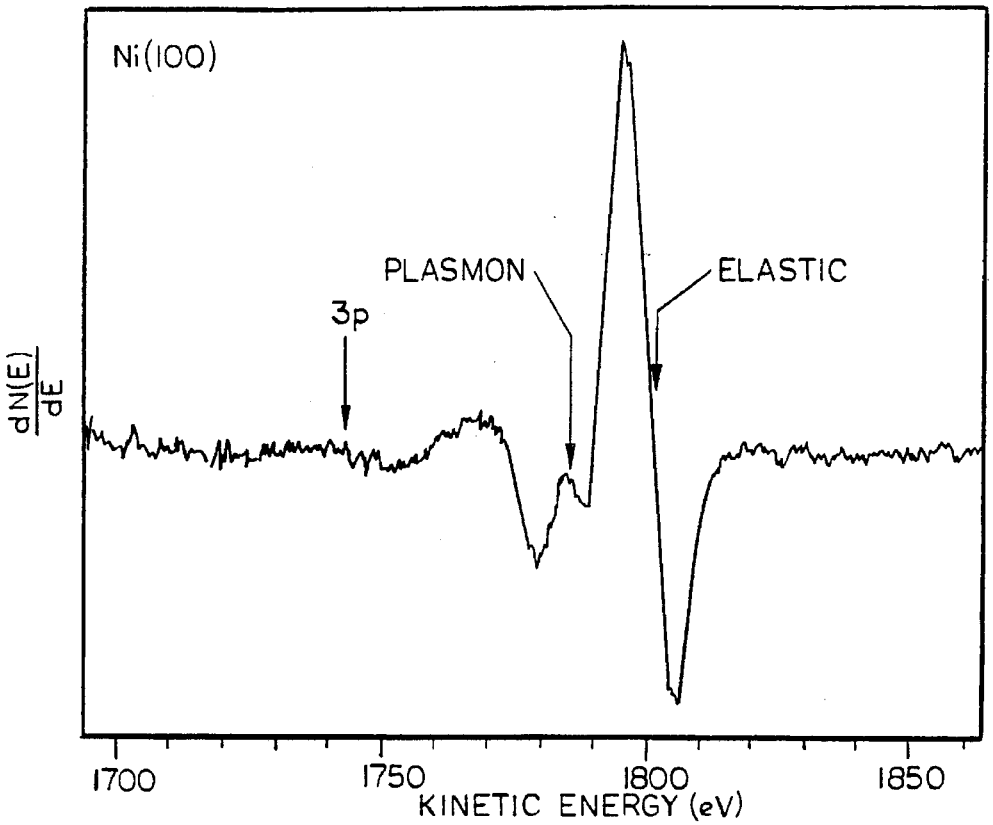
FIG. 4 depicts the differentiated spectrum of the elastic peak of electrons reflected off a flat nickel single crystal.

FIG. 4 depicts the results of a particle analysis experiment utilizing the present invention. The results show a differentiated spectrum of the elastic peak of electrons reflected off of the (100) surface of a flat nickel single crystal. The abscissal axis represents the kinetic energy level of the electron stream and the ordinate axis represents the derivative of the energy state of the electrons with respect to the electron energy. The instrumental line width of the elastic peak is discernable, and the instrumental energy resolution ($\Delta E/E_O$) of the analyzer was calculated as being 1.5%. An instrumental asymmetry of the signal was detected and determined as being introduced as a consequence of the inhomogeneities in the fields near the exit aperture 24 shown in FIG. 2 and due to the elimination of conducting mesh over the particle entry slit 20 and the particle exit slit 24 in an effort to increase electron transmission. The asymmetry is most apparent in the derivative of the elastic peak of FIG. 4.

Figure 5:
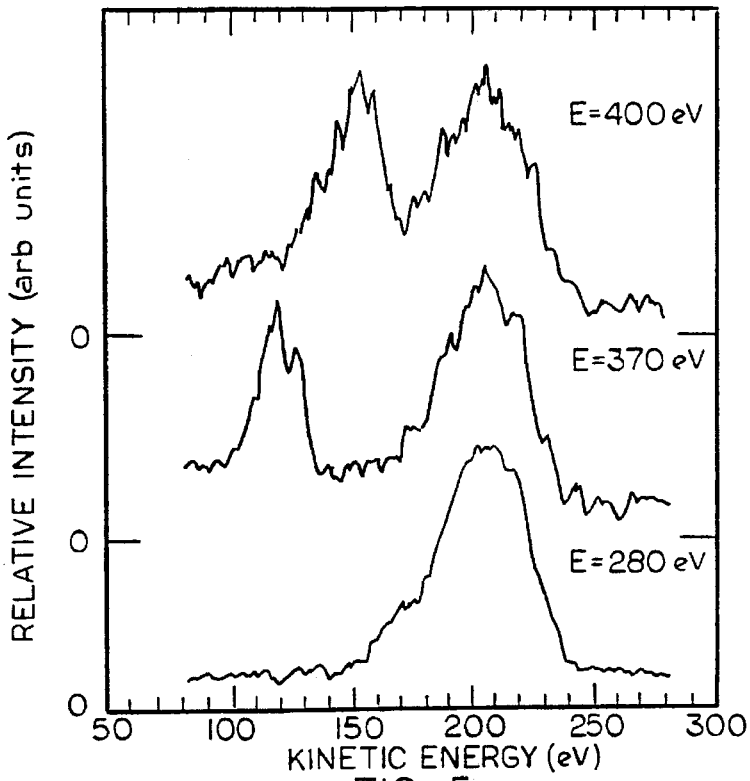
FIG. 5 shows Auger spectra of the atomic Ar LMM-Auger process at three different photon energies.

FIG. 5 is an illustration of the Auger spectra of the atomic Ar LMM-Auger process showing three different photon energies. The relative intensity of the electron stream in arb units versus electron kinetic energy is plotted in FIG. 5. The versatility of the present invention was demonstrated by the experiment which consisted of crossing tunable ionizing light from a synchrotron light source with an Ar beam. The photon energy was scanned across an energy range where Ar Auger electron yields are expected while the CMA was held at a constant pass energy, which in this case corresponded to the kinetic energy of the Ar LMM-Auger process. The analyzer 10 has also been utilized in constant final state spectroscopy and characteristic energy loss spectroscopy experiments.

The broad feature centered at kinetic energy of approximately 210 eV in the three spectra corresponds to the Ar Auger electrons, while the features at approximately 120 eV and 150 eV in the spectra acquired at respective photon energies of 370 eV and 400 eV originate form Ar 2p core electron excitations. The limitations of the resolution of the Auger spectra are attributable to sample volume effects and the inherent limitations of a smaller diameter cylindrical mirror analyzer.

When the signal originates from the surface of a solid, the sampling volume extends on the order of only a few angstroms below the surface, in which case the focus of the analyzer is well defined as originating from essential a point source resulting in sufficient instrument resolution. For atomic beam experiments such as depicted in FIG. 5, the sampling volume is the volume of the intersection of the atomic and photon beams. In such an experiment the focal point of the analyzer is no longer well defined and the point source approximation is no longer applicable. The effect is the broadening of the spectral features which has an adverse effect upon the instrumental resolution of the analyzer. However, when the analyzer is operated in a constant energy mode, the LMM Auger electron yield measurements of Ar clusters achieved much greater instrumental resolution.

The cylindrical mirror analyzer of the present invention simultaneously possesses reduced physical size and sufficient instrument resolution resulting in a versatile charged particle analyzer. The reduced size of the analyzer allows for mounting on a linear motion feedthrough thereby further contributing to the versatility and utility of the analyzer.

In view of the above detailed description of a preferred embodiment and modifications thereof, various other modifications will now become apparent to those skilled in the art. The claims below encompass the disclosed embodiments and all reasonable modifications and variations without departing from the spirit and scope of the invention.

What is claimed is:

1. A cylindrical mirror analyzer for analyzing the energy spectra of a stream of charged particles emitted from a charged particle source comprising:

(a) a cylindrical housing having first and second ends;

(b) an outer cylinder disposed at the first end of said cylindrical housing concentrically positioned therein having a conical end cap at the first end of said cylindrical housing with an aperture centrally located thereon;

(c) an inner cylinder electrically connected to ground potential and concentrically contained within said outer cylinder having a slit thereon exposed through the endcap of said outer cylinder, the slit being generally coincident with a diameter of said cylindrical housing for receiving the stream of charged particles and an exit slit through which the charged particles may pass;

(d) a manipulator at the second end of said cylindrical housing for manipulation of the cylindrical mirror analyzer into an analysis position; and (e) means electrically connected to said outer cylinder for controlling the stream of charged particles and for recording the experimental results.

2. The cylindrical mirror analyzer of claim 1 wherein said cylindrical housing comprises μ-metal.

3. The cylindrical mirror analyzer of claim 1 wherein said outer cylinder has an inner diameter of up to 50 millimeters.

4. The cylindrical mirror analyzer of claim 1 wherein said outer cylinder has an inner diameter of 30 millimeters.

5. The cylindrical mirror analyzer of claim 1 wherein said inner cylinder has an outer diameter of up to 40 millimeters.

6. The cylindrical mirror analyzer of claim I wherein said inner cylinder has an outer diameter of 15 millimeters.

7. The cylindrical mirror analyzer of claim 1 wherein said manipulator is a linear motion feedthrough.

8. The cylindrical mirror analyzer of claim 1 wherein said manipulator is mounted on a vacuum flange having a diameter less than 203 millimeters.

9. The cylindrical mirror analyzer of claim 6 wherein said vacuum flange is a 70 millimeter diameter conflat flange.

10. The cylindrical mirror analyzer of claim 1 further having a focal length of approximately 6 mm.

* * * * *